US006239554B1

(12) United States Patent
Tessadro et al.

(10) Patent No.: US 6,239,554 B1
(45) Date of Patent: May 29, 2001

(54) OPEN-LOOP LIGHT INTENSITY CALIBRATION SYSTEMS AND METHODS

(75) Inventors: Ana M. Tessadro, Seattle; Scott L. DeVore, Kirkland, both of WA (US)

(73) Assignee: Mitutoyo Corporation, Kawasaki (JP)

( * ) Notice: Subject to any disclaimer, the term of this patent is extended or adjusted under 35 U.S.C. 154(b) by 0 days.

(21) Appl. No.: 09/475,990

(22) Filed: Dec. 30, 1999

(51) Int. Cl.[7] ..... H05B 37/02
(52) U.S. Cl. ..... 315/149; 250/252.1
(58) Field of Search ..... 315/149; 250/252.1, 250/559.08, 559.1, 559.39

(56) References Cited

U.S. PATENT DOCUMENTS

| | | | | |
|---|---|---|---|---|
| 3,878,373 | * | 4/1975 | Blum | 250/252 |
| 4,843,229 | * | 6/1989 | Reed et al. | 250/213 VT |
| 4,843,476 | | 6/1989 | Fujioka et al. | 358/228 |
| 4,855,830 | * | 8/1989 | Davis et al. | 358/168 |
| 4,963,036 | | 10/1990 | Drisko et al. | 382/50 |
| 5,220,840 | * | 6/1993 | Neigoff et al. | 250/252.1 |
| 5,454,049 | | 9/1995 | Oki et al. | 382/172 |
| 6,087,656 | * | 7/2000 | Kimmich et al. | 250/252.1 |

* cited by examiner

*Primary Examiner*—David Vu
*Assistant Examiner*—Thuy Vinh Tran

(74) *Attorney, Agent, or Firm*—Oliff & Berridge, PLC

(57) ABSTRACT

The input light settings in many vision systems often do not correspond to fixed output light intensities. The relationships between the measured output light intensity and the input light intensity are inconsistent between vision systems or within a single vision system over time. This inconsistency makes it difficult to interchange part-programs even between visions systems of one model of vision systems, because a part program with one set of light intensity values might produce images of varying brightness on another vision system. However, many measurements depend on the brightness of the image. To solve this problem, a reference lighting curve is generated for a reference vision system, relating an input light intensity value to a resulting output light intensity. A corresponding specific lighting curve is generated for a specific vision system that corresponds to the reference vision system. A calibration function is determined that converts a reference input light intensity value into a specific input light intensity value. Accordingly, when an input light intensity value is input, the specific vision system is driven at a corresponding specific input light intensity value such that the output light intensity of the specific vision system is essentially the same as the output light intensity of the reference vision system when the reference vision system is driven at the input light intensity value. Thus, in a vision system calibrated using these lighting calibration systems and methods, the specific lighting behavior of that vision system is modified to follow a pre-defined, or reference, lighting behavior.

20 Claims, 9 Drawing Sheets

OPEN-LOOP LIGHT INTENSITY CALIBRATION SYSTEMS AND METHODS

BACKGROUND OF THE INVENTION

1. Field of the Invention

This invention relates to lighting systems for vision systems.

2. Description of Related Art

The light output of any device is a function of many variables. Some of the variables include the instantaneous drive current, the age of the device, the ambient temperature, whether there is any dirt or residue on the light source, the performance history of the device, etc. Machine vision instrument systems typically locate objects within their field of view using methods which may determine, among other things, the contrast within the region of interest where the objects may be found. To some degree, this determination is significantly affected by the amount of incident light or transmitted light.

Automated video inspection metrology instruments generally have a programming capability that allows an event sequence to be defined by the user. This can be implemented either in a deliberate manner, such as programming, for example, or through a recording mode which progressively learns the instrument sequence. The sequence commands are stored as a part program. The ability to create programs with instructions that perform a sequence of instrument events provides several benefits.

For example, more than one workpiece or instrument sequence can be performed with an assumed level of instrument repeatability. In addition, a plurality of instruments can execute a single program, so that a plurality of inspection operations can be performed simultaneously or at a later time. Additionally, the programming capability provides the ability to archive the operation results. Thus, the testing process can be analyzed and potential trouble spots in the workpiece or breakdowns in the controller can be identified. Without adequate standardization and repeatability, archived programs vary in performance over time and within different instruments of the same model and equipment.

Conventionally, as illustrated in U.S. Pat. No. 5,753,903 to Mahaney, closed-loop control systems are used to ensure that the output light intensity of a light source of a machine vision system was driven to a particular command level. Thus, these conventional closed-loop control systems prevent the output light intensity from drifting from the desired output light intensity due to variations in the instantaneous drive current, the age of the light source, the ambient temperature, or the like.

SUMMARY OF THE INVENTION

This invention is especially useful for producing reliable and repeatable results when using predetermined commands to the illumination system , such as when the command is included in a part-program that will be used on a different vision system, and/or on the same or a different vision system at a different time or place.

The input light settings in many vision systems often do not correspond to fixed output light intensities. Moreover, the output light intensity can not be measured directly by the user. Rather, the output light intensity is measured indirectly by measuring the brightness of the image. In general, the brightness of the image is the average gray level of the image. Alternatively, the output light intensity may be measured directly using specialized instruments external to a particular vision system.

In any case, the lighting behavior, i.e., the relationship between the measured output light intensity and the commanded light intensity, is not consistent between vision systems, or within a single vision system over time. Rather, the relationship between the measured output light intensity and the commanded light intensity depends on the optic elements of the vision system, the particular light source being used to illuminate a part, the particular bulb of that light source, and the like. For example, a first vision system having its stage light source set to an input light intensity command value of 30% may produce the same output light intensity as a second vision system having its stage light source set to an input light intensity command value of 70%. FIGS. 1–3 graphically illustrate this inconsistency of the lighting behavior between different vision systems, inconsistency within a single vision system when using different optical elements, and inconsistency within a single vision system when using the same optical elements and different light sources or when using the same optical elements and light source and different bulbs or lamps in that same light source.

These examples are given to show how different the lighting behaviors may be depending on the particular vision system, optical elements and light sources. By design, the same lighting behavior cannot be expected to occur on different classes of vision systems or on the same vision system when using different optical elements and/or light sources. In practice, the illumination may also vary on different particular vision systems of the same class of vision system due to variations in components and/or alignment.

This inconsistency of the lighting behavior makes it difficult to interchange part-programs between even similar particular visions systems of the same class of vision systems. When a part program is developed on one particular vision system, that part program often does not run on another particular vision system, even when that other particular vision system is the same class as the first vision system. That is, a part program with a fixed set of commanded light intensity values might produce images of varying brightness on different vision systems. However, many measurement algorithms, such as algorithms using edge detection, depend on the brightness of the image. As a result, because the brightnesses of resulting images generated using different vision systems are almost assured to be different, part programs do not run consistently on different vision systems.

This invention provides lighting calibration systems and methods that enable open loop control of light sources of vision systems.

This invention additionally provides lighting calibration systems and methods that can be implemented entirely in software and/or firmware.

This invention separately provides lighting calibration systems and methods that calibrate a particular vision system to a reference vision system.

This invention additionally provides lighting calibration systems and methods that use reference lighting curves for each particular class of vision systems.

This invention further provides lighting calibration systems and methods that provide different reference lighting curves for each of the different light sources of each particular class of vision systems.

This invention separately provides lighting calibration systems and methods that ensure uniformity between different vision systems of each particular class of vision systems.

This invention separately provides lighting calibration systems and methods that permit repeated re-calibration.

This invention separately provides lighting calibration systems and methods that ensure the light output intensity of a light source of a particular vision system remains uniform over time.

This invention additionally provides lighting calibration systems and methods that ensure the output light intensity remains uniform over time by re-calibrating a particular light source of a particular vision system.

In various exemplary embodiments of the lighting calibration systems and methods according to this invention, a reference lighting curve for each lighting source of a particular class of vision systems is created. Each reference lighting curve is generated by providing, for a particular light source, an input light intensity command value and measuring the resulting output light intensity that reaches the light sensor of the vision system. The light sensor maybe the camera of the vision system. The amount of light reaching the light sensor of the vision system will be an essentially nonlinear function of the lamp output when driven at the input light intensity command value and any attenuation of the intensity of the light as output from the light source, i.e., a function of the lamp intensity, the power of the optics, and the response of the optical elements of the vision system. For each value of the input light intensity command value over a range of possible input light intensity command values, the resulting measured output light intensity is determined.

Then, a specific lighting curve is generated in the same way for the corresponding light source for a specific vision system of the class of vision systems that correspond to the reference vision system. Additionally, reference lighting curves and specific lighting curves can be generated for each different lighting source of the class of vision systems.

Once a specific lighting curve for a particular light source of a specific vision system is created, a calibration function is determined that converts a reference light intensity command value into a specific light intensity command value. As a result, when an input light intensity command value is input, the light source of the specific vision system is driven at a corresponding specific input light intensity command value such that the output light intensity value of the specific vision system is essentially the same as the output light intensity value of the reference vision system when the reference vision system is driven at the input light intensity command value.

Thus, in a vision system calibrated using the lighting calibration systems and methods according to this invention, the specific lighting behavior of that vision system is modified to follow a pre-defined, or reference, lighting behavior. The lighting calibration systems and methods according to this invention reduce lighting variations in the amount of illumination delivered for a given input setting by establishing a controlled lighting behavior. This is done by using a reference lighting curve that associates a definite brightness for every input setting. In various exemplary visions systems, a number of different light sources, such as a stage light, a coaxial light, a ring light and/or a programmable ring light, can be provided. In exemplary vision systems having multiple light sources, a different reference lighting curve will be developed for each different light source light.

Thus, the lighting calibration systems and methods according to this invention reduce the inconsistency of the lighting behavior between machines by establishing a controlled lighting behavior. That is, using the lighting calibration systems and methods according to this invention, calibrated vision systems will produce similar brightness under similar input light settings. Additionally, using the lighting calibration systems and methods according to this invention, a part program can be consistently run on a calibrated vision system and part programs can be run on different calibrated vision systems. The lighting calibration systems and methods according to this invention will reduce lighting variations in the amount of illumination delivered for a given user setting by establishing a controlled lighting behavior.

These and other features and advantages of this invention are described in or are apparent from the following detailed description of the preferred embodiments.

BRIEF DESCRIPTION OF THE DRAWINGS

The preferred embodiments of this invention will be described in detail, with reference to the following figures, wherein.

DETAILED DESCRIPTION OF THE EXEMPLARY EMBODIMENTS

Figure 4:
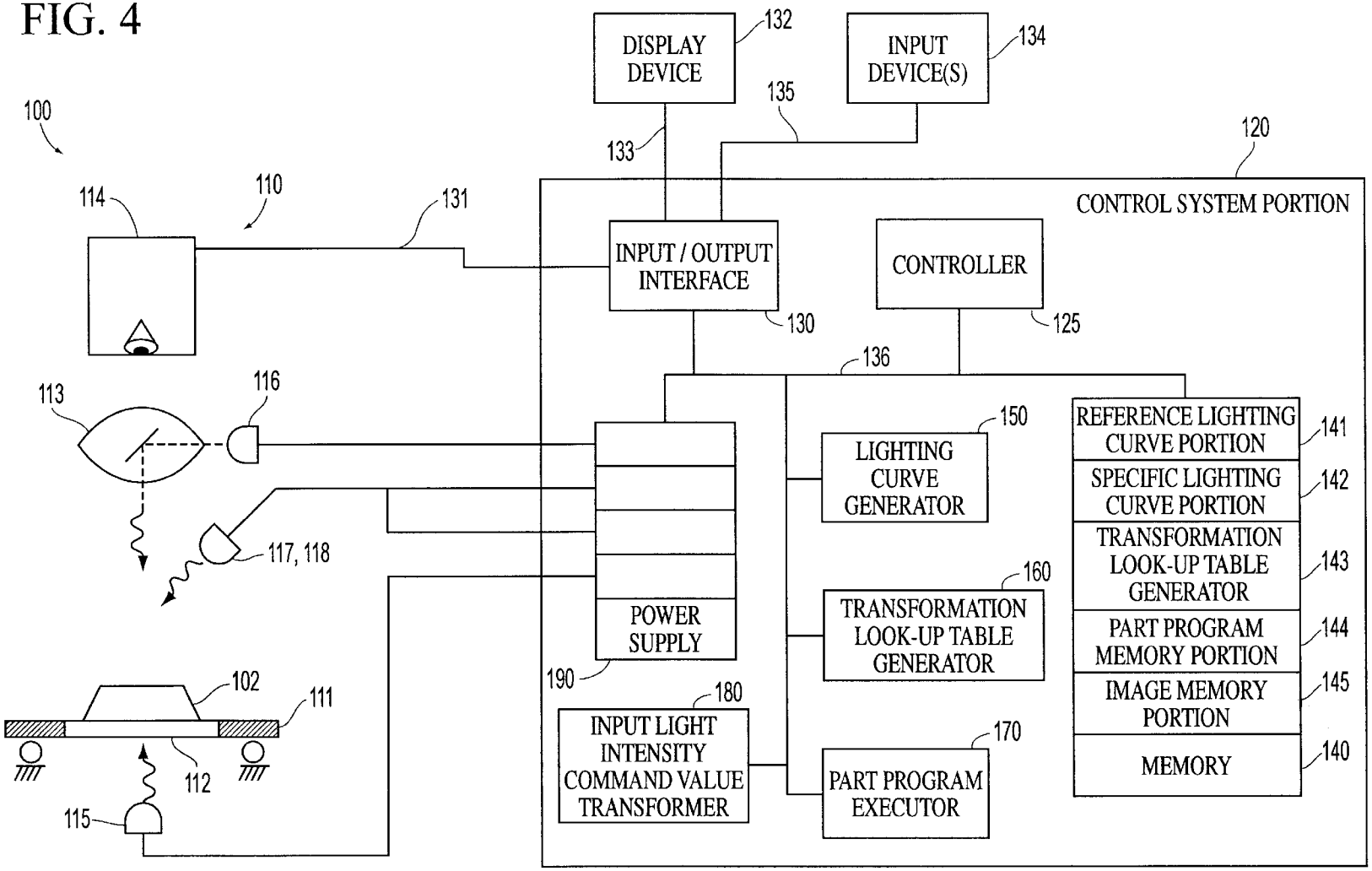
FIG. 4 shows one exemplary embodiment of a vision system using one exemplary embodiment of a light intensity control system according to this invention.

For simplicity and clarification, the operating principles, and design factors of this invention are explained with reference to one exemplary embodiment of a vision system according to this invention as shown in FIG. 4. The basic explanation of the operation of the vision system shown in FIG. 4 is applicable for the understanding and design of any vision system that incorporates the lighting calibration systems and methods according to this invention.

As used herein, the input light intensity command value "$V_i$" is the light intensity value set by the user to control the light output intensity of the source light. The input light intensity command value is set either expressly in a part program or using a user interface. The range of the input light intensity command value is between zero and one, which represents a percentage of the maximum output intensity possible. In the following description, the ranges 0–1 and 0%–100% are used interchangeably. It should be appreciated that zero or 0% corresponds to no illumination, while 1 or 100% corresponds to full illumination.

As used herein, the output light intensity value "I" is the intensity of the light source of the vision system as delivered to the part and received by the optical sensor of the vision system after passing back and forth through the optical elements of the vision system. In various exemplary embodiments, the output light intensity value I is measured using an average gray level of a region of the image. However, any appropriate known or later developed method for measuring the output light intensity value I can be used with the lighting calibration systems and methods according to this invention.

As used herein, the lighting curve or lighting behavior "f" of a vision system is the relationship between the range of output light intensity values I of a vision system and the range of input light intensity command values $V_i$ of that vision system:

$$I=fV_i.$$

As used herein, the calibrated input light intensity command value $V_c$ is the light intensity value used to control the light output intensity of the source light that is determined using the lighting calibration systems and methods according to this invention. In the lighting calibration systems and methods according to this invention, the calibrated input light intensity command value is not apparent to the user. Rather, the user provides a desired input light intensity command value to a vision system calibrated using the lighting calibration systems and methods according to this invention. The desired input light intensity command value is converted to the calibrated input light intensity command value by the calibrated vision system. This is the value that is used to govern the light controller hardware that controls the light source of the vision system. Like the input light intensity command value $V_i$, the range of the calibrated input light intensity command value $V_c$ is between zero and one.

For any vision system, each source light of that vision system has a specific lighting curve. The specific lighting curve will generally be different for different vision systems. By calibrating a vision system, the specific lighting curve will be automatically modified to follow a reference lighting curve determined for that light source for that class of vision systems. This is done by converting the input light intensity command values $V_i$ to calibrated input light intensity command values $V_c$ prior to sending the input light intensity command values to the low-level lighting control system. This is done using a transformation T, where:

$$TV_i=V_c.$$

The transformation T is determined using the specific lighting curve and the reference lighting curve. After calibration, for any input light intensity command value, the calibrated vision system is expected to produce an image having a brightness that is similar to the brightness specified by the reference lighting curve.

Figure 1:
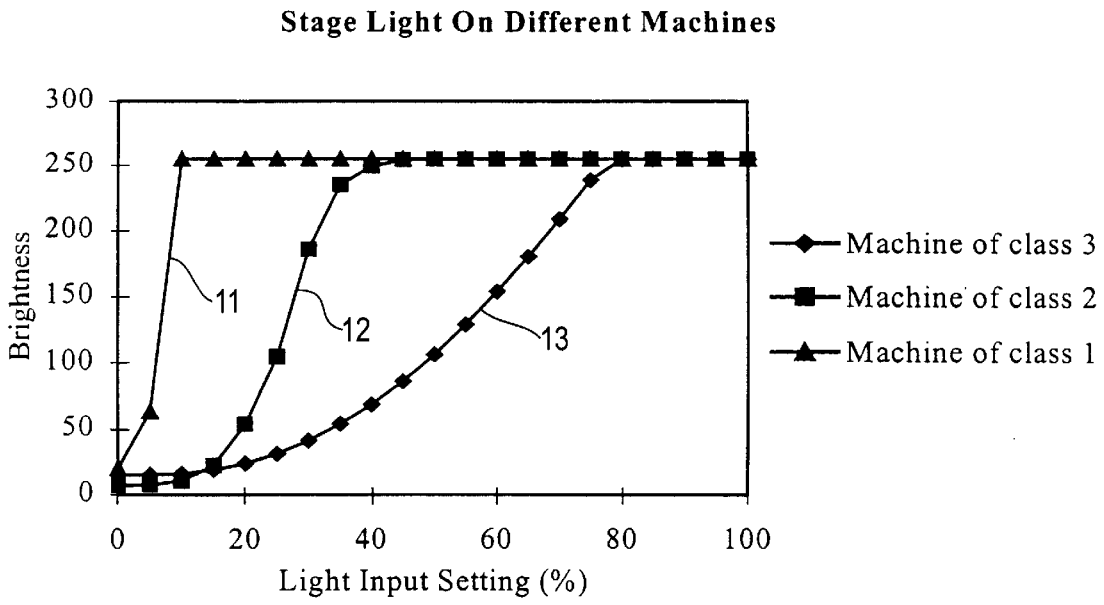
FIG. 1 is a graph illustrating the inconsistency of the lighting curves between different classes of vision systems.

FIG. 1 is a graph illustrating inconsistencies within specific lighting curves for different classes of vision systems. In particular, FIG. 1 shows the specific lighting curves 11, 12 and 13 for three different classes of machines. Each specific lighting curve was generated using the same magnification level and light source. As shown in FIG. 1, for the specific lighting curve 11 for a first type or class of vision system represented by the triangular points, there is very little usable range for the input light intensity command values. That is, at an input light intensity command value of 0, due to stray ambient lighting, and also due to electronic offsets in the CCD camera, the output intensity level has a brightness of approximately 20 on an 8-bit range of digitized values, i.e., from 0 to 255. However, an input intensity command value of 5% for the first class of vision systems has a brightness greater than 50, while all input light intensity command values greater than 10% are saturated at a maximum output intensity value of 255.

In contrast, a second type or class of vision systems, represented by the square points, has a larger, but still significantly constrained, range of usable input light intensity command values. That is, as shown in FIG. 1, for the second class of vision systems, for input light intensity command values of less than 20%, the slope of the specific lighting curve 12 is very shallow. However, for input intensity command values between 20% and 40%, the slope of the specific lighting curve 12 is very steep. Furthermore, for input intensity command values greater than 40%, the output intensity value is again saturated at the maximum value of 255. In contrast to both the first and second specific lighting curves 11 and 12, a specific lighting curve 13 for a third type or class of vision system, represented by the diamond-shaped points, has a much shallower slope over its entire length. Additionally, the third specific lighting curve 13 does not reach the saturation value of 255 until the input light intensity command value is approximately 75%–80%.

As a result of these three different types or classes of vision systems having the three different specific lighting curves 11, 12 and 13 shown in FIG. 1, a part program written for any one of these types or classes of vision systems will not work on any of the other types or classes of vision systems. For example, if a particular part program written for the second class of vision systems, using the second specific lighting curve 12, requires an output intensity value of approximately 200, the part program will include an input light intensity command value of approximately 30–35%. If the same part program is then run on a vision system of the first class of vision systems, an input light intensity command value of between 30–35% will cause the output intensity value to be saturated at the 255 level. In contrast, if that part program is run on a vision system of the third class or type of vision systems, the input light intensity command value of between 30–35% will result in an output intensity value of approximately 50.

Thus, when this part program is run on the first type or class of vision systems, the image will be too bright, and the part program will not be able to properly identify the visual elements in the captured image. In contrast, when this part program is run on the third type or class of vision systems, the resulting image will be underexposed, again making it impossible for visual elements to be discerned in the image. In both of these cases, because the visual elements of the image cannot be properly identified, the part program will not run properly.

Figure 2:
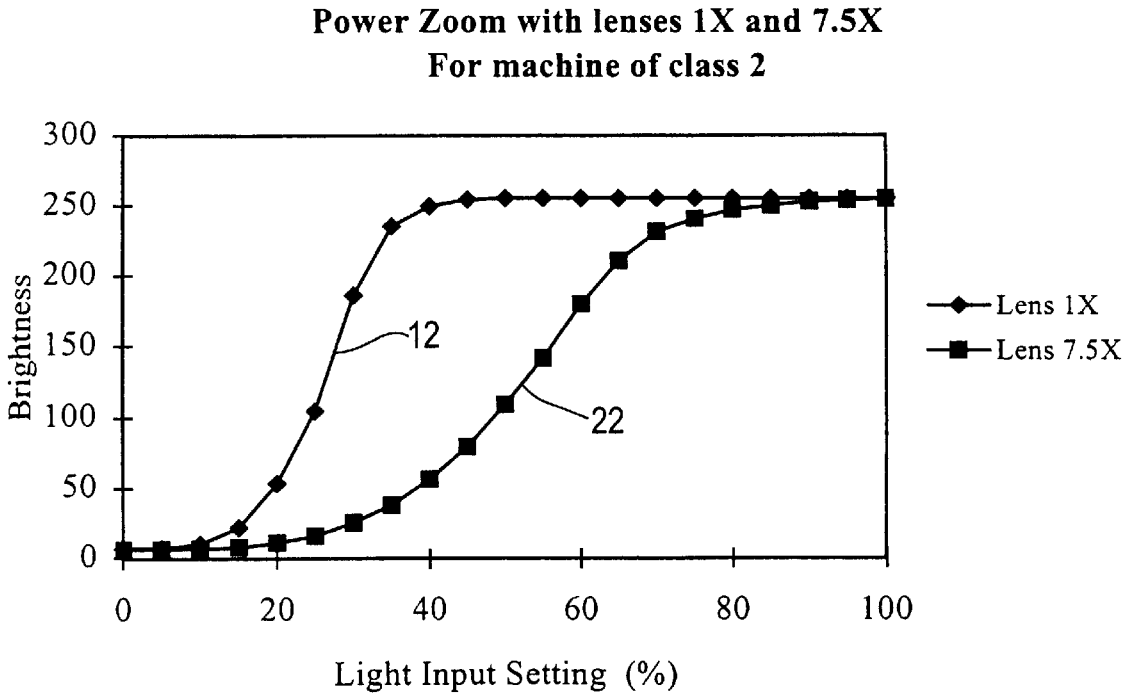
FIG. 2 is a graph illustrating the inconsistency of the lighting curve on the same vision system when using different optical elements.

FIG. 2 is a graph illustrating the inconsistencies in the specific lighting curves for a single vision system using different optical elements or different configurations of the same optical elements. That is, as shown in FIG. 2, the first specific lighting curve 12 for this vision system is generated using a magnification of 1×. This magnification can be obtained by either using a first set of optical elements or by placing a single set of optical elements into a first configuration. FIG. 2 also shows a second specific lighting curve 22 for this same vision system at a second, higher magnification of 7.5. This second magnification can be obtained either by using a different set of optical elements that provide higher magnification, or by placing the single set of optical elements into a second, higher magnification, configuration.

In any case, the reference lighting curve 12 for the second class of vision systems was generated with the optical system of this vision system at a magnification of 1. In contrast, the second specific lighting curve 22 for this second type of vision system has a much flatter slope. Thus, while the first reference curve 12 indicates that this vision system, when in a 1× magnification configuration, will generate an output intensity value of 50 at an input intensity command value of 20%, the second specific lighting curve 22 indicates that this vision system, when in a 7.5× magnification configuration, does not generate an output intensity value of 50 until the input light intensity command value is between 30% and 40%. Moreover, the second specific lighting curve 22 indicates that this vision system, when in a 7.5× configuration, is driven at an input intensity command value of 40%, in order to obtain a brightness of approximately 50, the first specific lighting curve 12 indicates that this vision system, when in a 1× configuration, is driven at that same 40% input intensity command value, a saturated output intensity value of 255 results. In contrast, the second specific lighting curve 22 indicates that this vision system, when in a 7.5× configuration, does not reach the saturated output intensity value of 255 until the input light intensity command value is approximately 90%.

Thus, for a part program written for a 1× magnification for this vision system, if the desired output intensity value is 50, an input intensity command value of approximately 20% is necessary. However, if the same part program were run on this vision system at a 7.5× magnification, an input intensity command value of approximately 20% would barely begin to provide any light to the part, as the resulting output intensity value would barely be above 0. In contrast, for a part program requiring a desired brightness of 50% and using a magnification of 7.5×, the input intensity command value for this vision system would be approximately 40%. If this part program were subsequently run on this vision system with the optics at a 1× magnification, the output intensity value would be approximately 250.

It should be appreciated that there is a similar inconsistency in the specific lighting curve for the same vision system when using the same optical elements or configuration but using different light sources. As shown in FIG. 4, the surface light is placed generally between the camera and the part to be imaged and shines on the part and away from the camera. Thus, the light reaching the camera must be reflected from the part to be imaged. In contrast, the stage light shines directly into the camera.

Therefore, in general, due to these types of variations, for any input light intensity command value, different light sources will respond differently to the same input light intensity command value. Thus, it should be appreciated that, if the same part program is to be run with similar lighting commands to different light sources, a transformation between the specific lighting curves for the different light sources and a reference lighting curve is desirable.

Figure 3:
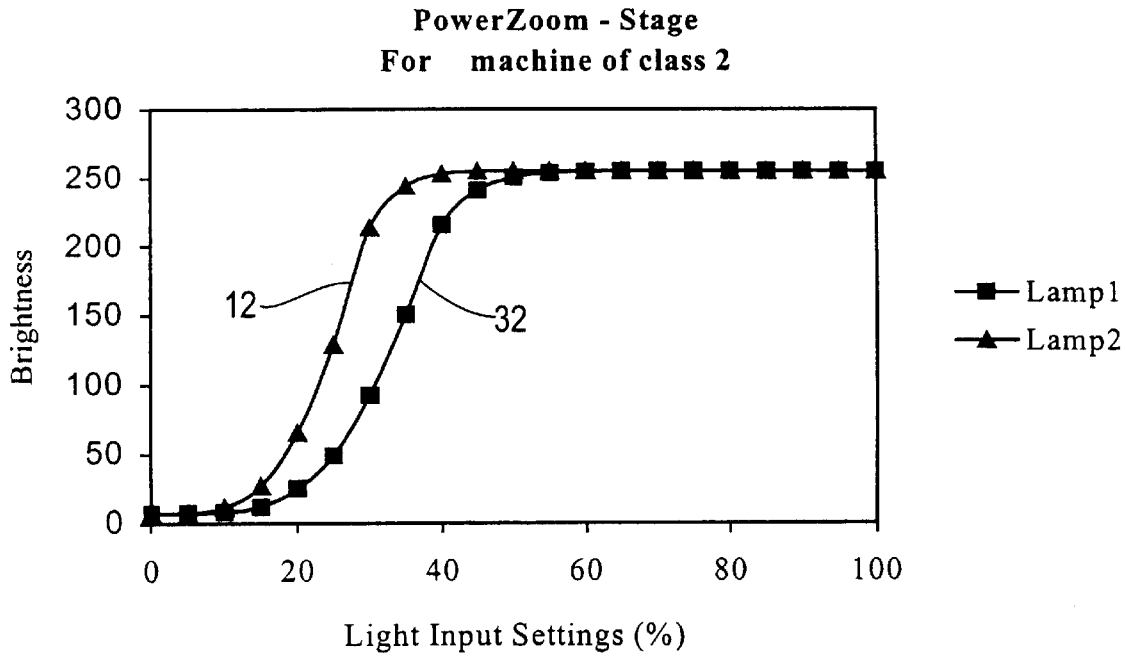
FIG. 3 is a graph illustrating the inconsistency of the lighting curve on the same vision system, using the same optical elements and the same light source but different bulbs or lamps in that same light source.

FIG. 3 is a graph illustrating the inconsistency of the specific lighting curve for the same vision system when using the same optical elements or configuration and when using the same light source, but using different bulbs or lamps within that same light source. In particular, as shown in FIG. 3, the specific lighting curve 12 for a particular vision system of the second type of vision system was generated at a first magnification using a first light source, such as a stage light, with first bulb or lamp. However, the specific lighting curve 32 was generated using the same particular vision system of the second type of vision system, at the first magnification and using the same first light source, with a second bulb or lamp.

For any input light intensity command value, more light from the first bulb or lamp represented by the specific lighting curve 12 reaches the camera than for the second bulb or lamp represented by the specific lighting curve 32. Thus, for any input intensity command value, the output intensity value for the specific lighting curve 12 is greater than the output intensity value for the specific lighting curve 32. Accordingly, while it is not as dramatic as the examples shown in FIGS. 1 and 2, for a part program written using the light source with a particular bulb or lamp, when the same part program is run using the same light source but a different bulb or lamp, either too much or too little light will reach the camera.

FIG. 4 shows one exemplary embodiment of a vision system incorporating one exemplary embodiment of a light intensity control system according to this invention. As shown in FIG. 4, the vision system 100 includes a vision system components portion 110 and a control portion 120. The vision system components portion 110 includes a stage 111 having a central transparent portion 112. A part 102 to be imaged using the vision system 100 is placed on the stage 111. Light emitted by one of the light sources 115–118 illuminates the part 102. The light from the light sources 115–118 passes through a lens system 113 after illuminating the part 102, and possibly before illuminating the part 102, and is gathered by a camera system 114 to generate an image of the part 102. The light sources used to illuminate the part 102 include a stage light 115, a coaxial light 116, and a surface light, such as a ring light 117 or a programmable ring light 118.

The image captured by the camera is output on a signal line 131 to the control portion 120. As shown in FIG. 4, one exemplary embodiment of the control portion 120 includes a controller 125, an input/output interface 130, a memory 140, a lighting curve generator 150, a transformation generator 160, a part program executor 170, an input light intensity command value transformer 180, and a power supply 190, each interconnected either by a data/control bus 136 or by direct connections between the various elements. The signal line 131 from the camera system 114 is connected to the input/output interface 130. Also connected to the input/output interface 130 can be a display 132 connected over a signal line 133 and one or more input devices 134 connected over one or more signal lines 135. The display 132 and the one or more input devices 134 can be used to view, create and modify part programs, to view the images captured by the camera system 114 and/or to directly control the vision system components 110. However, it should be appreciated that, in a fully automated system having a predefined part program, the display 132 and/or the one or more input devices 134, and the corresponding signal lines 133 and/or 135 may be omitted.

As shown in FIG. 1, the memory 140 includes a reference lighting curve portion 141, a specific lighting curve portion 142, a transformation look-up table storage portion 143, a part program storage portion 144, and a captured image storage portion 145. The reference lighting curve portion 141 stores one or more reference lighting curves. In particular, the reference lighting curve portion 141 can store one reference lighting curve for each different lighting source. In other various embodiments, the reference lighting curve portion 141 may store multiple reference lighting curves for each lighting source for each of a number of different exemplary reference parts and/or may store multiple reference lighting curves for each of a number of different magnifications. Similarly, the specific lighting curve portion 142 stores at least one specific lighting curve. In particular, the specific lighting curve portion 142 can include one specific lighting curve for each of the different lighting sources 115–118. Like the reference lighting curve portion 141, the specific lighting portion 142 can also store multiple specific lighting curves for each of the different lighting sources for a number of different magnifications.

The transformation look-up table memory portion 143 stores at least one transformation look-up table. In particular, the transformation look-up table memory portion 143 stores one transformation look-up table for each pair of corresponding reference and specific lighting curves stored in the reference and specific lighting curve portions 141 and 142.

The part program memory portion 144 stores one or more part programs used to control the operation of the vision system 100 for particular types of parts. The image memory portion 145 stores images captured using the camera system 114 when operating the vision system 100.

The lighting curve generator 150, upon the vision system 100 receiving a lighting curve generating command, under control of the controller 125, generates either the reference lighting curve or the specific lighting curve for a particular light source and/or a particular target. In general, the user will use the display 132 and at least one of the one or more input devices 134 to enter a lighting curve generator command signal to the lighting curve generator 150 when first setting up the vision system 100 and whenever the user believes the vision system 100 needs to be recalibrated.

In general, the lighting curve generator 150 will be used to generate a reference lighting curve only for a reference vision system corresponding to the vision system 100. Subsequently, the reference lighting curve generated using that reference vision system will be stored in the reference lighting curve portion 141 of the memory 140. In contrast, the lighting curve generator 150 of a vision system 100 will generally be used to generate the specific lighting curves that are specific to that vision system 100. The specific lighting curves will be stored in the specific lighting curve portion 142 of the memory 140.

Whenever the lighting curve generator 150 has been used to generate new specific lighting curves, the transformation generator 160, under control of the controller 125, then generates a new transformation look-up table for each such newly generated specific lighting curve stored in the specific lighting curve portion 142 and the corresponding reference lighting curve stored in the reference lighting curve portion 141. Each such transformation look-up table is then stored over the corresponding previous transformation look-up table by the transformation generator 160 in the transformation look-up table portion 143 of the memory 140.

When the vision system 100 receives a command to execute a part program stored in the part program memory portion 144, the part program executor 170, under control of the controller 125, begins reading instructions of the part program stored in the part program memory portion 144 and executing the read instructions. In particular, the instructions may include a command to turn on or otherwise adjust one of the light sources 115–118. In particular, such a command will include an input light intensity command value. When the part program executor 170 encounters such a light source instruction, the part program executor 170 outputs the input light intensity command value instruction to the input light intensity command value transformer 180. The input light intensity command value transformer 180, under control of the controller 125, inputs the transformation look-up table corresponding to the light source identified in the light source instruction and converts the input light intensity command value into a converted or specific input light intensity command value. This converted input light intensity command value is a command value that, when used to drive the light source identified in the light source instruction, causes that light source to output light at an intensity that will result in the output intensity value of the light at the camera system 114 to be essentially the same as the output intensity value that would occur if the light source of the reference vision system were driven at the input light intensity command value.

The input light intensity command value transformer 180 then outputs the converted input intensity command value to the power source 190, while the part program executor outputs a command to the power source 190 identifying the light source to be driven. The power source 190 then drives the identified light source based on the converted input light intensity command value by supplying a current signal over one of the signal lines 119 to one of the light sources 115–118 of the vision system components 110.

It should be appreciated that any one of the various light sources 115–118 described above can include a plurality of differently colored light sources. That is, for example, the stage light 115 can include a red light source, a green light source and a blue light source. Each of the red, blue and green light sources of the stage light 115 will be separately driven by the power source 190. Thus, each of the red, blue and green light sources of the stage light 115 will have its own specific lighting curve. Thus, each of the red, blue and green light sources of the stage light 115 needs to have its own reference lighting curve and its own transform. Having such reference lighting curves for colored sources allows for more reliable color illumination and is potentially useful for quantitative color analysis using either color or black/white cameras.

It should also be appreciated that the foregoing description of the systems and methods of this invention is based on automatic program operation. The systems and methods of this invention operate substantially the same when the illumination commands are issued manually through the one or more input devices 134 during manual or stepwise operation of the vision system 100.

Table 1 shows a reference lighting curve for a particular class of vision systems, the specific lighting curve of a corresponding vision system that has not been calibrated and the specific lighting curve of the same vision system after being calibrated using that reference lighting curve. After being calibrated, the largest difference in the brightness between the specific lighting curve and the reference lighting curve is 2%. In contrast, before being calibrated, the largest difference in the brightness between the specific lighting curve and the reference lighting curve is 15%.

TABLE 1

Lighting behavior before and after calibration.

| Input Light Setting % | Reference Lighting Curve Gray Level | Specific Lighting Curve before calibration Gray Level | Difference % | Specific Lighting Curve after calibration Gray Level | Difference % |
|---|---|---|---|---|---|
| 0 | 12.5 | 12.5 | 0 | 12.5 | 0 |
| 10 | 12.8 | 12.9 | 1 | 12.8 | 0 |
| 20 | 14.6 | 14.1 | 3 | 14.4 | −1 |
| 30 | 21.2 | 23 | 8 | 20.9 | −1 |
| 40 | 34.8 | 39.3 | 13 | 34.8 | 0 |
| 50 | 59.1 | 67.6 | 14 | 60.1 | 2 |
| 60 | 96.3 | 110.6 | 15 | 95.3 | −1 |
| 70 | 148.1 | 169.8 | 15 | 149.1 | 1 |
| 80 | 216.8 | 247.5 | 14 | 220.8 | 2 |
| 90 | 254.3 | 255 | — | 255 | — |
| 100 | 255 | 255 | — | 255 | — |

The reference and specific lighting curves define the relationships between the measured output light intensity I and the input light intensity command value $V_i$. To obtain a lighting curve, each input light intensity command value $V_i$ yields an output light intensity $I_i$ as measured by the camera system of the vision system. This measurement is obtained from a region smaller than the full field of view of the camera system and is hereafter referred to as the brightness of the image. The brightness of the image is measured as the average gray level in a window of the image. It should be appreciated that both the window size and the window location can affect the measured gray level.

For an exemplary camera system having image dimensions of 640×480 pixels, several window sizes were used to determine the average gray level. These window sizes included windows of 51×51 pixels, 101×101 pixels, 151×151 pixels, 201×201 pixels, and 251×251 pixels. The windows have an odd number of columns and rows of pixels so that the windows are symmetric around their centers.

Figure 5:
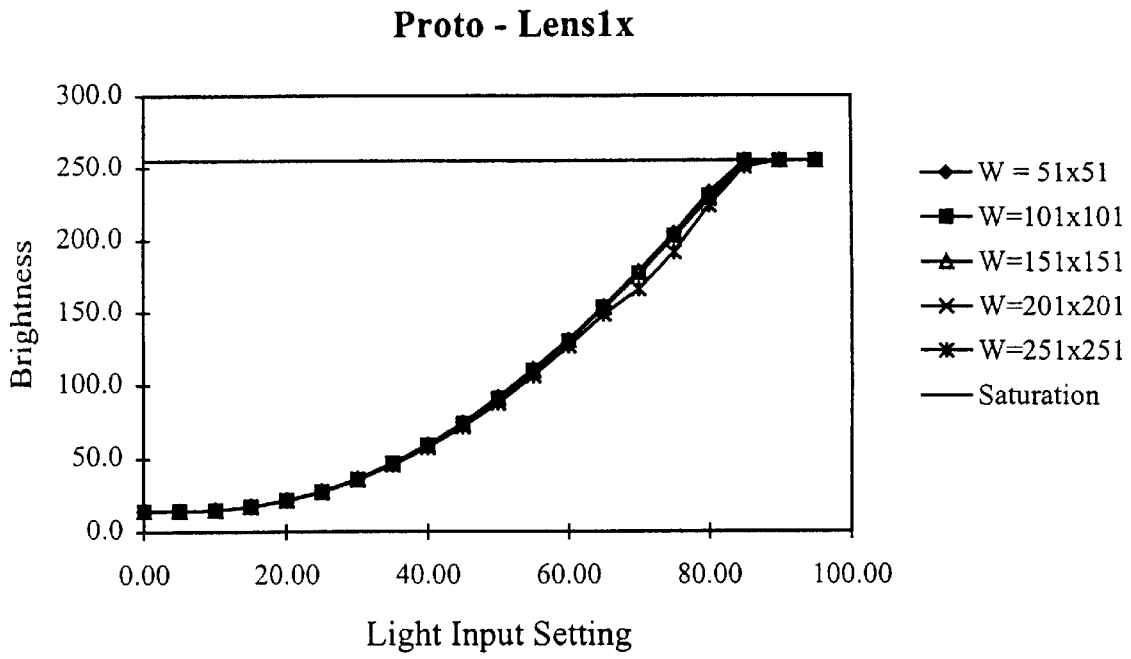
FIG. 5 is a graph illustrating the effect of window size on determining the brightness of the image.

FIG. 5 shows the output light intensity values for this camera system over the range of input light intensity command values for each of these five window sizes. As shown in FIG. 5, there is no significant difference between these five different window sizes. However, the gray level of a small window, such as a window of 51×51 pixels, might not be a good representation of the average gray level of the image when there is significant non-uniformities in the brightness across the entire field of view of the camera system. In various exemplary embodiments, a window having 151×151 pixels is used, as it provides an appropriate balance between window size and camera field of view.

As indicated above, the brightness of the image might not be uniform. It should also be appreciated that, in this case, the brightest portion of the image might not be at the center of the image. In order to reduce the influence of the non-uniform brightness on the robustness of the lighting curve, in various exemplary embodiments, a window centered on the brightest location of the image can be used.

The reference lighting curve is the model lighting curved that will be followed for any calibrated machine. In various exemplary embodiments, the lighting calibration systems and methods of this invention can be simplified by using the same reference lighting curve for every class of vision system and for every type of light source, such as, for example stage lights, coaxial lights, ring lights, and/or programmable ring lights. In these exemplary embodiments, any vision system with any light source would be able to produce the same lighting behavior.

However, in various other exemplary embodiments, using a single reference lighting curve is inappropriate in view of the substantial differences among different classes of vision systems and among different light sources. In these exemplary embodiments, using a single reference lighting curve would undermine the lighting capabilities of some classes of vision systems. Having the same reference lighting curve for all the different light sources on the same vision system would also undermine the lighting capabilities of some light sources, such as the stage light that usually produces the brightest image.

Thus, in these various other exemplary embodiments, a different reference lighting curve is used for each class of vision system and for each light source used in each such class of vision system. This approach assures that the lighting behavior of every light source will be similar on machines of the same model. Additionally, when using a programmable right light that has four quadrants, each quadrant of the programmable ring light will use the same reference lighting curve, because, for the same input light intensity command value, each quadrant of the programmable Ting light is supposed to produce images with similar brightness.

However, using a unique reference lighting curve for each light source of the same class of vision systems implies having one reference lighting curve for all the magnifications of that class of vision systems. In various exemplary embodiments, the reference lighting curve was established using a default magnification. For example, for a particular class of visions systems that are manufactured with a default lens system having a 2.5× magnification, the 2.5× magnification is used as the default magnification. However, using a lower magnification, for example 1×, will produce a better calibration because it will take advantage of the full resolution of the lighting system.

Using a single magnification value for all of the reference lighting curves of a particular class of vision systems assures that equal magnifications on different machines of the class of vision systems will have similar lighting behavior. However, this does not assure that different magnifications on the same class of vision systems will produce the same lighting behavior.

As indicated above, each reference lighting curve should take advantage of the full lighting power of the particular light source and produce images-allowing good contrast i.e., with a wide gray level range. Taking these requirements into account, each reference lighting curve should have the following characteristics:

1. The reference lighting curve should not reach the maximum brightness value, i.e., saturation, until the input light intensity command value is at least 90%. Ideally, the reference lighting curve will not reach the saturation over the entire range of the input light intensity command value;

2. Over as much of the range as possible, except at the extreme ends of the range, where illumination characteristics may prevent it, the reference lighting curve should have different brightness values for different input light values. That is, if several input light intensity command values generate an output intensity value representing the same brightness value, the utility of such a reference lighting curve is reduced in those portions of the curve; and 3. The range of input light settings should cover most of the range of output light intensity. If the reference lighting curve does not cover a wide range of output light intensity, then it is difficult to obtain images with good contrast.

Figure 6:
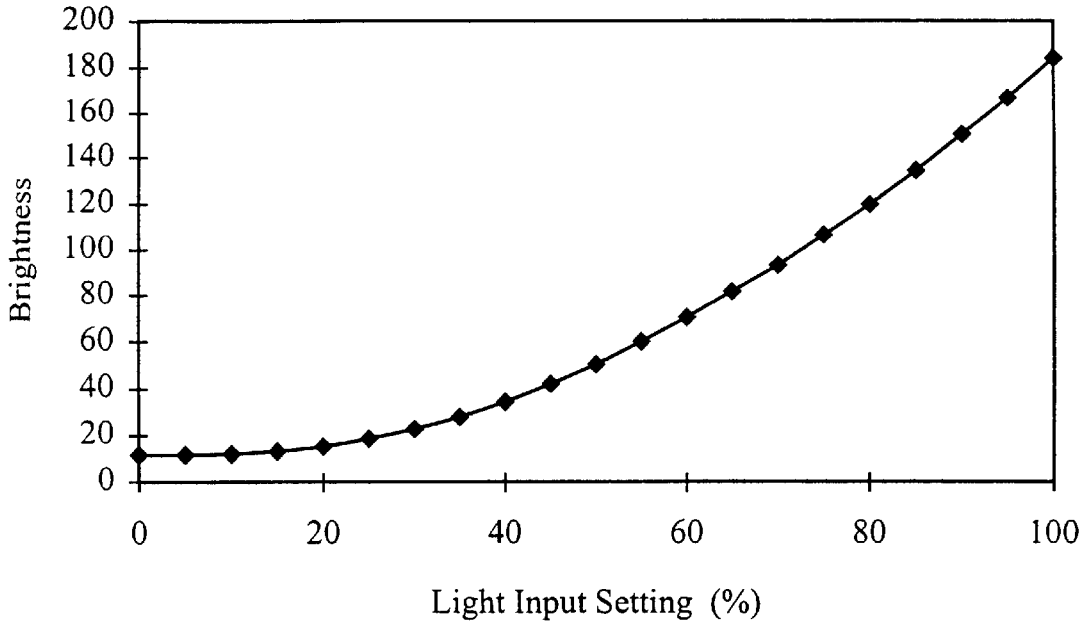
FIG. 6 is a graph illustrating a lighting curve that meets a first requirement for a reference lighting curve.

While FIG. 1 shows three curves that do not meet the first requirement, FIG. 6 shows a curve that does meet the first requirement. The first requirement recognized that, if the reference lighting curve reaches the maximum brightness 255 at a saturating input light intensity command value $V_{sat}$ that is much less than 100%, then it is not possible to calibrate any input light intensity command value $V_i$ that is greater than the saturating input light intensity command value $V_{sat}$.

Figure 7:
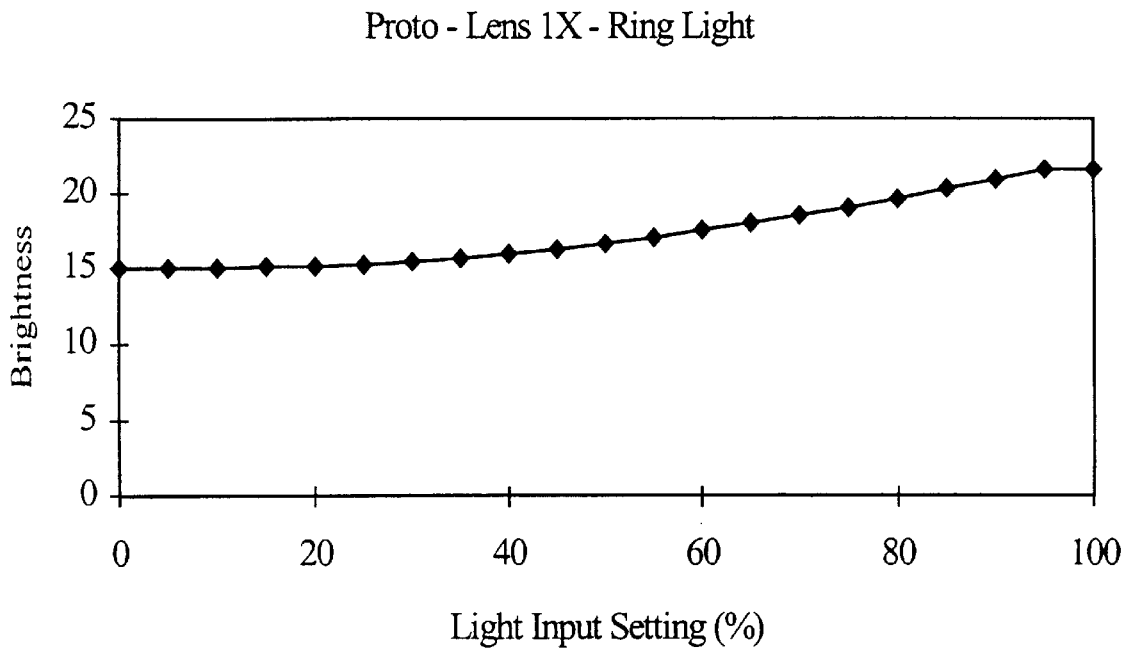
FIG. 7 is a graph illustrating a lighting curve that does not meet a second requirement for the reference lighting curve.

FIG. 7 shows an example of a reference lighting curve that does not meet the second requirement. In the reference lighting curve shown in FIG. 7, the input light intensity command values 0%–20% all have an output intensity value of 15. In addition, the range of output light intensity is poor, 15–23. Therefore, a calibration using this reference lighting curve reduces the ability to obtain good images.

As indicated above, different light sources produce different types of lighting curves. If the lighting curves are measured without some appropriate target located in the field of view of the camera, the resulting lighting curves might not meet the first-third requirements for the reference lighting curve described above. This problem is obviated by using optical targets between the stage and the camera in order to obtain lighting curves that meet the first-third requirements. It should be appreciated that, however, the role of the targets is different for each different light source. For example, in various exemplary embodiments of vision systems, the stage light needs targets that attenuate in transmission the intensity of the light. In contrast, the coaxial light needs targets that attenuate in reflection the intensity of the light. In contrast to both stage and coaxial lights, the ring and programmable ring lights need targets that gather in reflection the intensity of the light coming from the ring light, or from the programmable ring light in different directions.

Moreover, it should be appreciated that it may be necessary or desirable to use several targets for each light source. If only a single target is used for the full range of the input light setting, that single target may attenuate too much of the intensity of the light source. As a result, several input light intensity command values may have the same output light intensity. In this case, the resulting reference lighting curve would fail to meet the second requirement for the reference lighting curve described above.

Table 2 indicates the targets usable to obtain a reference lighting curve meeting the first-third requirements for the 2.5× lens in the QV202-PRO machine model of the QuickVision series of vision systems produced by Mitutoyo Corporation of Japan. It should be appreciated that every class of vision system and every light source may need different targets.

TABLE 2

Targets used for reference lighting curves for the LIH machine.

| Stage | Coaxial | Program. Ring Light Top, Bottom, Right, |
|---|---|---|
| Neutral Density Filters | Spectralon ® 2% | Spectralon ® 99 % |

The measurement of the reference lighting curve for the stage light uses several neutral density filters, having optical densities of 0.1, 1, 2, 3. Spectralon® is a diffuse reflecting material, and it is available in different reflectance values, ranging from 2% to 99%. Spectralon® is available at Labsphere, www.labsphere.com. Spectralon® 2%, Labsphere part no. SRT-02-020, is 2% diffuse reflectance at 600 nm. Spectralon® 99%, Labsphere part no. SRT-90-020, is 99% diffuse reflectance at 600 nm.

For the stage light, measuring the reference lighting curve began at the lowest input light intensity command value and using the neutral density filter with an optical density of 0.1. At the input light intensity command value that saturates the output intensity value when using the neutral density filter with an optical density of 0.1, the measurements continue using the filter with an optical density of 1. At the input light intensity command value that saturates the output intensity value when using the neutral density filter with an optical density of 1, the measurements continue using the neutral density filter with an optical density of 2. This process continues using filters with higher optical density until the full input light intensity command value range has been measured.

Table 3 shows an example of an exemplary reference lighting table for the stage light. Each entry of the table comprises a triplet of the form $\{V_i, OD_i, I_i\}$ where:

$V_i$ is the input light intensity command value;

$OD_i$ is the optical density of the filter used for input light intensity command value $V_i$; and $I_i$ is the output light intensity for the input light setting $V_i$.

TABLE 3

Example of reference lighting curve for stage light.

| V | OD | I |
|---|---|---|
| 0 | 0.1 | 25 |
| 0.1 | 0.1 | 45 |
| 0.2 | 0.1 | 105 |
| 0.3 | 0.1 | 155 |
| 0.4 | 0.1 | 220 |
| 0.5 | 1 | 100 |
| 0.6 | 1 | 175 |
| 0.7 | 1 | 230 |
| 0.8 | 2 | 225 |
| 0.9 | 2 | 240 |
| 1 | 3 | 230 |

For the coaxial light, measuring the reference lighting curve began at the lowest input light intensity command value and using no target. At the input light intensity command value that saturates the output intensity value when using no target, the measurements continue using the Spectralon® 2% target. It should be also be appreciated that it may be suitable to use several targets to obtain a smoother reference lighting curve, for example Spectralon® 10%, 20%, etc. A ground glass target, such as Edmund Scientific part no. H45655 can be used instead of the Spectralon® 2% target. The performance of this ground glass target is not as good but it is much cheaper.

For the coaxial light, the second requirement could not be met. Even using a target that reflects only 2% of the light, the output light intensity saturates at input light intensity command value of 60%. For testing purposes a Spectralon® 3.7% target obtained from Labsphere was used.

In an exemplary reference lighting table for the coaxial light, each entry of the table comprises a triplet of the form $\{V_i, F_i, I_i\}$ where:

$V_i$ is the input light intensity command value;

$F_i$ is the filter used for the input light intensity command value $V_i$, i.e. nothing or Spectralon® 2%; and $I_i$ is the output light intensity for the input light setting $V_i$.

For the ring light, measuring the reference lighting curve began at the lowest input light intensity command value and using the Spectralon® 99% target. At the input light intensity command value that saturates the output intensity value when using the Spectralon® 99% target, the measurements continue using no target. Instead of Spectralon® 99%, opal diffusing glass, such as Edmund Scientific part no. H43718, could be used. Opal diffusing glass is cheaper, and has similar performance to the Spectralon® 99% target. However, opal diffusing glass does not have technical specifications. That is, there is no calibration data for opal diffusing glass targets. It should also be appreciated that it may be suitable to use several targets to obtain a smoother reference lighting curve, for example by using Spectralon® 99%, Spectrally 75%, and Spectrally 50%, as the output intensity value saturates.

In an exemplary reference lighting table for the ring light, each entry of the table comprises a triplet of the form $\{V_i, F_i, I_i\}$ where:

$V_i$ is the input light intensity command value;

$F_i$ is the filter used for the input light intensity command value $V_i$, i.e. nothing or Spectralon® 99%; and $I_i$ is the output light intensity for the input light setting $V_i$.

The reference lighting curve for a light source is obtained independently of the others. That is, the other light sources are turned off. The reference lighting curve is measured only once. Once the reference lighting curve is measured and the measured data is stored, such as in the tabular forms outlined above, the measured reference lighting curve data can be stored in a memory of the vision system.

To calibrate a vision system, a specific lighting curve is measured for every light source of that vision system that needs to be calibrated. The specific lighting curve for a light source is obtained independently of the others. That is, the other light sources are turned off. The same magnification and the same targets used to obtain a particular reference lighting curve must be used to obtain the corresponding specific lighting curve. The specific lighting curve must be re-measured every time that the vision system is calibrated. In general, the older the light source is, the more often the user may wish to calibrate the vision system illumination. Once the specific lighting curve is measured and the measured data is stored, such as in the tabular forms outlined above, the measured specific lighting curve data can be stored in a memory of the vision system.

After the specific lighting curve or curves for a particular vision system are measured or re-measured and stored in the memory of that vision system, using the reference lighting curve for that vision system's class of visions systems, the light source or sources to be calibrated can be calibrated by determining a transformation T. The transformation T converts an input light intensity command value, which is defined relative to the reference lighting curve for a particular light source of a particular vision system, into a converted input light intensity command value defined relative to that particular vision system and light source.

For a particular light source of a particular vision system, if the reference lighting curve is:

$$R(x)=y,$$

where:

R is the reference lighting curve function;

x is the reference input light intensity command value, and $0 \leqq x \leqq 1$; and y is the reference output light intensity; and $0 \leqq y \leqq 255$.

and the specific lighting curve of the machine is:

$$S(x)=y',$$

where:

S is the specific lighting curve function;

x is the reference input light intensity command value, and $0 \leqq x \leqq 1$; and y' is the specific output light intensity; and $0 \leqq y' \leqq 255$.

then that light source of that vision system is calibrated by determining the transformation function T such that:

$$T(x)=x'; \text{ and}$$

$$S(x')=y;$$

where:

x is the reference input light intensity command value, and $0 \leqq x \leqq 1$;

x' is the specific input light intensity command value, and $0 \leqq x \leqq 1$; and y is the reference output light intensity; and $0 \leqq y \leqq 255$.

It should be appreciated that it may not be possible to reproduce the reference output light intensity, or brightness, y due to the resolution of the lighting system. That is, a specific input light intensity command value x' may not exist such that driving the particular light source using the specific input light intensity command value x', a specific lighting curve will result in the reference output light intensity, or brightness, y. Therefore, in various exemplary embodiments of the transformation function T, a margin of error is provided by using a tolerance value e. In this case, that light source of that vision system is calibrated by determining the transformation T such that:

$$T(x)=x'; \text{ and}$$

$$S(x')=(y \pm e).$$

Occasionally, it may be mathematically impossible to calculate the transformation T. This situation occurs when the specific lighting curve does not reach the brightness levels established by the reference lighting curve. This occurs when the particular light source has become too dim or there is a misalignment of the optical system, i.e., the lens system and/or the camera system, of the vision system.

The transformation function T is determined off-line, and is determined each time the vision system is calibrated. The transformation function T is used at run time to convert the light input settings.

The transformation function T is calculated using the reference lighting curve and the specific lighting curve, both obtained with the default magnification. However, the transformation function T will be used regardless of the magnification. Therefore, the transformation function T does not assure that different magnifications on the same vision system will produce the same lighting behavior. Rather, the transformation function T assures that equal magnifications on different machines of the same class of vision system will have similar lighting behaviors.

TABLE 4

Results of using the same transformation function T for different magnifications and machines

| | Machine A Lens 1X Brightness | Machine B Lens 1X Brightness | Machine A Lens 3X Brightness | Machine B Lens 3X Brightness |
|---|---|---|---|---|
| Light Input Value 30% | 150 | 150 | 100 | 100 |

Figure 8:
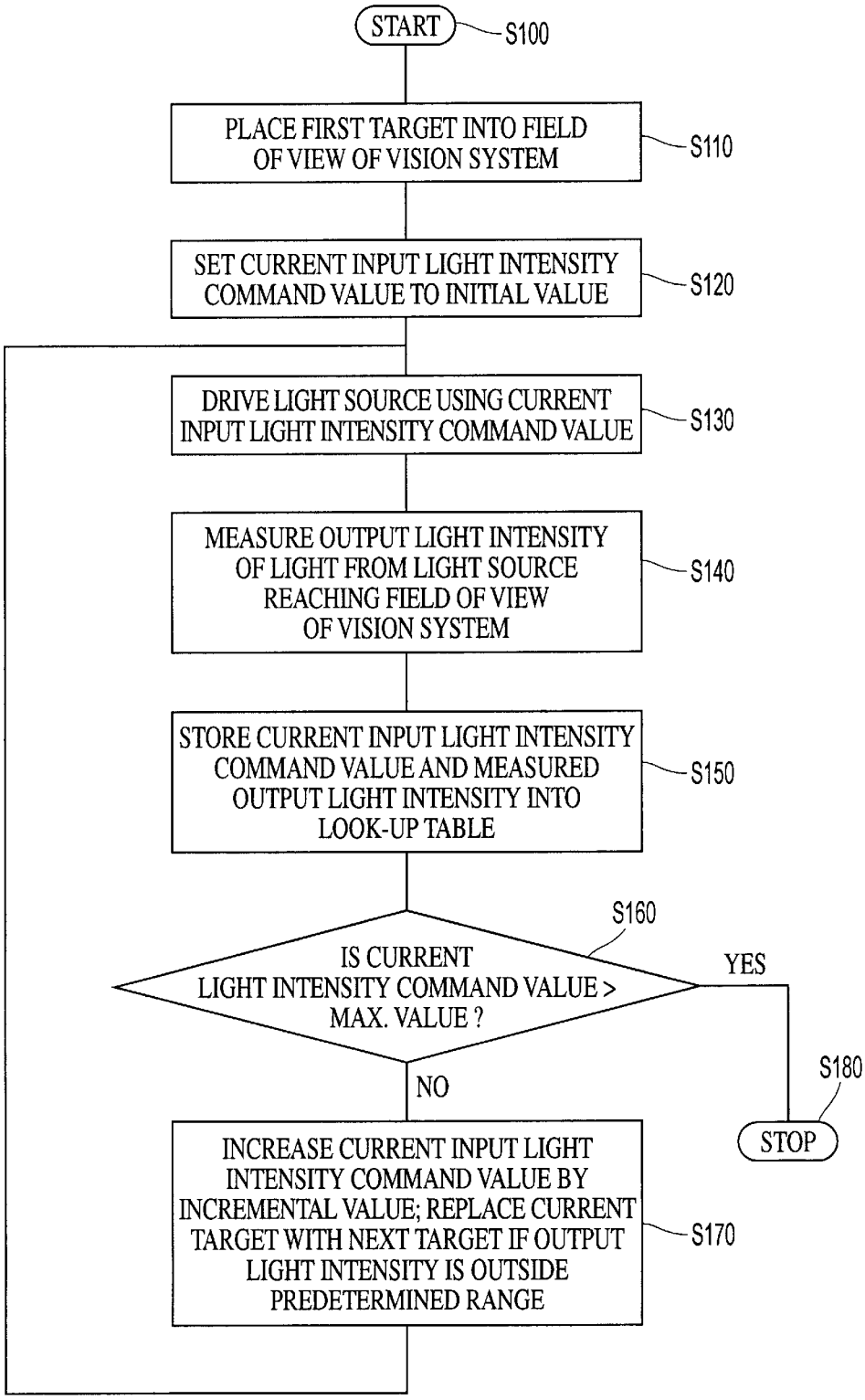
FIG. 8 is a flowchart outlining one exemplary embodiment of a method for generating a reference or specific lighting curve according to this invention.

FIG. 8 is a flowchart outlining one exemplary embodiment of a method for generating a lighting curve according to this invention. It should be appreciated that the steps shown in FIG. 8 can be used to generate both a reference lighting curve for a reference vision system and a specific lighting curve for a vision system that is to be calibrated. In either case, beginning in step S100, control continues to step S110, where a specific target is placed into the field of view of the vision system. Next, in step S120, the current input light intensity command value is set to an initial value. In general, the initial value will generally be 0, i.e., the light source will be turned off. Then, in step S130, the light source for which the lighting curve is being generated is driven using the current input light intensity command value. Control then continues to step S140.

In step S140, the output light intensity of the light output by the driven light source and reaching the field of view of the camera of the vision system through the optical elements is measured. Then, in step S150, the current input light intensity command value and the measured output light intensity is stored into a look-up table. Next, in step S160, a determination is made whether the current light intensity command value is greater than a maximum light intensity command value. If not, control continues to step S170. Otherwise, control jumps to step S180.

In step S170, the current input light intensity command value is increased by an incremental value. In addition, if the measured output light intensity value is outside a predetermined range, such as, for example, at a saturation value or a value that approaches saturation, the next appropriate target is placed into the field of view of the vision system in place of the current target. It should further be appreciated that determining whether the measured output light intensity value has reached a value that approaches saturation can include determining whether the measured output light intensity value is within a predetermined threshold of the saturation value. Control then jumps back to step S130. In contrast, in step S180, the method ends.

Figure 9:
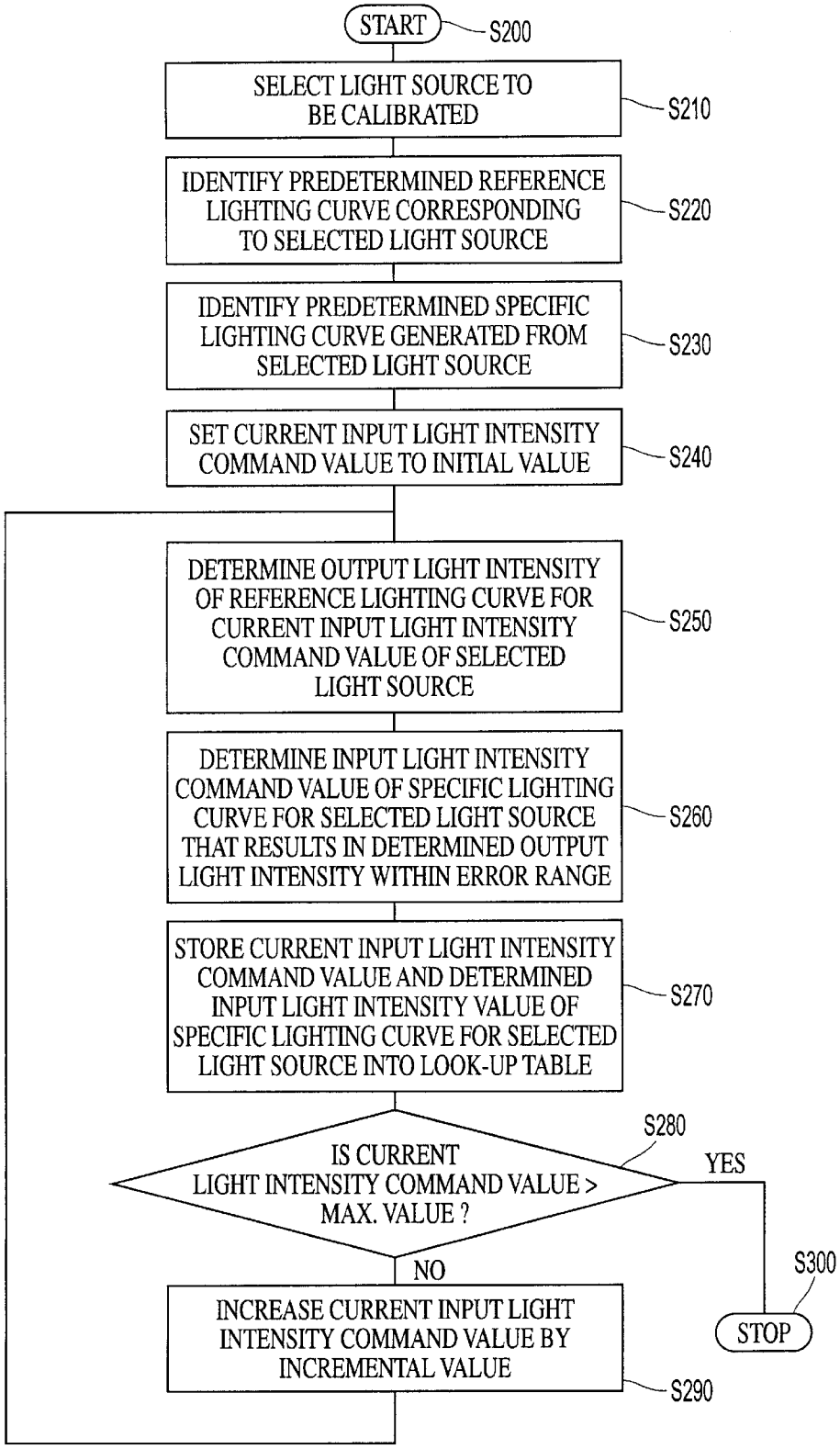
FIG. 9 is a flowchart outlining one exemplary embodiment of a method for calibrating a specific vision system using the reference lighting curve for that class of vision systems and the specific lighting curve for that specific vision system according to this invention.

FIG. 9 is a flowchart outlining one exemplary embodiment of a method for generating the transformation function based on the reference lighting curve and the specific lighting curve for the particular light source of a particular vision system. Beginning in step S200, control continues to step S210, where the light source of the particular vision system to be calibrated is selected. Next, in step S220, the predetermined reference lighting curve corresponding to the selected light source of the particular vision system is identified. Then, in step S230, the predetermined specific lighting curve generated from the selected light source of the particular vision system is identified. Control then continues to step S240.

In step S240, the current input light intensity command value is set to an initial value. Then, in step S250, the output light intensity of the reference lighting curve for the current input light intensity command value of the selected light source is determined from the identified reference lighting curve. Next, in step S260, the input light intensity command value of the identified specific lighting curve for the selected. light source that results in the determined output light intensity is determined based on the identified specific lighting curve, at least within a selected error range. Control then continues to step S270.

In step S270, the current input light intensity command value and the determined input light intensity value of the identified specific lighting curve for the selected light source are stored into a transformation function look-up table. Next, in step S280, a determination is made whether the current light intensity command value is greater than a maximum light intensity command value. If so, control jumps to step S300. Otherwise, control continues to step S290.

In step S290, the current input intensity command value is increased by an incremental value. Control then jumps back to step S250. In contrast, in step S300, the method ends.

It should be appreciated that, in various exemplary embodiments where all intended illumination sources are to be able to produce illumination corresponding to the reference lighting curve, the reference lighting curve is based on the "weakest" illumination of the target class of vision systems. Thus, any "stronger" illumination source, or bulb, will be able to match the maximum output intensity of the "weakest" illumination source or bulb.

It should also be appreciated that, not only do lower-powered optical elements and configurations gather the most light, but lower-powered optics and optical configurations themselves absorb less light. That is, the lower-powered optics and optical configurations capture more of the image. Thus, the lower-powered optics and optical configurations inherently capture more of the available light generated and emitted by the particular light source being driven. In addition, higher-powered optics and optical configurations themselves absorb more of the light incident on the optical elements. Thus, not only do higher-powered optics and optical configurations gather less light, but they also transmit less of the amount of light that is actually gathered.

In either case, using higher-powered optics and optical configurations makes the reference lighting curve too flat. Thus, it becomes difficult to discriminate between the output light intensities that will result from particular ones of the input light intensity command values for such flattened reference lighting curves.

At the same time, because the lower-powered optics and optical configurations gather more of the light emitted by the particular light source being driven, and because the lower-powered optics and optical configurations absorb less of the incident light, the lower-powered optics lower-powered optics and optical configurations are more likely to saturate the camera system, and otherwise be too steep such that the different between two adjacent input light intensity command values generates too great a difference in output intensity values.

Accordingly, it should be appreciated that the particular optical power to be used when generating the reference and specific lighting curves can significantly affect the usefulness of the transformation function.

It should also be appreciated that it is generally advisable to select the brightest region of the calibration image. The brightest region should be selected for a number of reasons.

First, selecting the brightest region tends to avoid the effects of inconsistent field of view illumination patterns. Such inconsistent field of view illumination patterns can arise because between any two vision systems, the optics may not be aligned identically. In fact, the optics of any particular vision system may be quite poorly aligned. For example, for the coaxial light source, the coaxial lamp may not be aligned on the optical axis.

Although most of the non-uniformity on the brightness of the image is attributable to the optics, there may be other sources of non-uniformity. For example, the camera system often uses charge-coupled devices (CCDs). Such CCDs may have response gradients across their vertical or horizontal dimensions. In any case, the effects of many potential gradients and non-uniformities of brightness are mitigated when the brightest region of the calibration image is selected.

Additionally, it should be appreciated that any one of several different schemes for selecting the region of the calibration image to be used can be selected from. As indicated above, a single window can be focused on the brightest spot of the calibration image. Alternatively, a single window can be fixed on a particular spot within the calibration image. This is often useful when the brightest region of the calibration image is known to be in a particular location, but the exact location of the brightest region is not known.

Determining the brightest region of the calibration image can consume considerable time and computational resources. On the other hand, if the brightest region of the calibration image is known to be located at a more or less fixed location within the calibration image, it may be possible to select a window that is essentially assured of containing the brightest spot. At the same time, by using such a fixed window, the computational resources and time necessary to determine the exact brightest spot and to center the window on that brightest spot can be avoided.

Furthermore, rather than using a single fixed window, multiple windows distributed throughout the calibration image can be used. For example, four windows focused generally on the four comers of the calibration image can be used. In this case, the average output intensity value of the four windows is used as the determined output intensity value. It should also be appreciated that, rather than an average, any other known or later developed statistical parameter could be used to combine the multiple windows to determine a single output intensity value.

It should be appreciated that, as outlined above, the transformation function T adjusts the specific input light intensity command value for the particular vision system so that the output light intensity for this particular vision system closely follows the output light intensity of the reference lighting curve. However, it should be appreciated that the reference lighting curve itself may not be particularly intuitive. Thus, the transformation function and/or the reference lighting curve might also be used to achieve a desired mapping of the output light intensity to a reference lighting curve that provides a desired function between the reference input light intensity command value and the reference output light intensity. Thus, the reference lighting curve and/or the transformation function may layer on a desired function, such as a linear function, a logarithmic function or the like, or a function that, in view of human psychology and visual perception, makes the output light intensity a more intuitive function of the input light intensity command value.

It should be appreciated that, as indicated above with the coaxial light, it may be difficult to find a non-saturation region that extends significantly over the range of the input light intensity value. To obviate this problem, it may be possible to mathematically, rather than experimentally, convert, or map, the transformation using assumptions about the optics of the vision system. Thus, it may be possible to extrapolate the results using a single target which corresponds to only a portion of the reference lighting curve to a range that corresponds to the entire reference lighting curve, based on assumptions about the magnification and reflectance within the optics systems.

As indicated above, different magnification levels usually result in different reference lighting curves. In the various exemplary embodiments, to deal with this, a single default magnification level is used when generating the reference and specific lighting curves and when generating the transformation function. Additionally, as indicated above, reference and specific lighting curves can be generated for different magnification levels. However, it should be appreciated that generating additional sets of lighting curves is not necessary.

Rather, to compensate for changing magnification levels, the compensation can be done in more rigid manner by multiplying any input light intensity command value when changing by a given amount of magnification. However, it should be appreciated that this more rigid computation method does not always produce a good image. Alternatively, a second transformation can be generated that based on the brightness of an initial magnification level, reproduces the brightness of the previous magnification level at the current magnification level.

It should also be appreciated that the above outlined calibration method is based on a light source having a single color. Thus, it should be appreciated that, if the light source has two or more color sources, such as a solid state light source that has multiple emitters emitting at different wavelengths, different reference lighting curves and different specific lighting curves can be generated for each of the different colors. Thus, different calibration tables can be generated for each of the different colors.

In various exemplary embodiments, the reference lighting curve can be obtained using a part program that saves the reference lighting curve in tabular form in a file. To generate the reference lighting curve, for each input light intensity command value, the light output intensity is measured as the average gray level in a window 151×151 pixels centered on the brightest location of the image. In various exemplary embodiments, only one target is used. In various exemplary embodiments, only a 2.5× magnification was used. In various exemplary embodiments, to obtain the reference lighting curve, a dimmest lamp for each light source from a sample of lamps for that light source can be used. Table 5 illustrates one exemplary embodiment of a reference lighting curve saved in tabular form in a file.

TABLE 5

| Reference lighting curve | |
|---|---|
| Input Light Setting | Brightness |
| 0.00 | 14.9 |
| 0.05 | 14.9 |
| 0.10 | 15.2 |
| 0.15 | 16.1 |
| 0.20 | 18.6 |
| 0.25 | 21.7 |
| 0.30 | 24.9 |
| 0.35 | 30.6 |

TABLE 5-continued

| Reference lighting curve | |
|---|---|
| Input Light Setting | Brightness |
| 0.40 | 36.7 |
| 0.45 | 43.6 |
| 0.50 | 51.5 |
| 0.55 | 60.9 |
| 0.60 | 69.1 |
| 0.65 | 82.3 |
| 0.70 | 94.1 |
| 0.75 | 106.7 |
| 0.80 | 121.0 |
| 0.85 | 132.7 |
| 0.90 | 152.1 |
| 0.95 | 167.6 |
| 1.00 | 184.7 |

The specific lighting curve can be obtained similarly to the reference lighting curve. Thus, in various exemplary embodiments, a part program is used to measure the output light intensity, or brightness, of the image at different input light intensity command values. The output light intensity, or brightness, of the image was measured as the average gray level of a window of 151×151 pixels centered on the brightest location in the image. Table 6 illustrates one exemplary embodiment of a specific lighting curve saved in tabular form in a file.

TABLE 6

| Specific lighting curve of an uncalibrated vision system | |
|---|---|
| Input Light Setting | Brightness |
| 0.00 | 14.9 |
| 0.05 | 14.9 |
| 0.10 | 15.2 |
| 0.15 | 16.3 |
| 0.20 | 20.1 |
| 0.25 | 25.7 |
| 0.30 | 31.7 |
| 0.35 | 44.1 |
| 0.40 | 56.9 |
| 0.45 | 71.5 |
| 0.50 | 87.6 |
| 0.55 | 108.2 |
| 0.60 | 128.0 |
| 0.65 | 157.6 |
| 0.70 | 183.8 |
| 0.75 | 213.0 |
| 0.80 | 244.0 |
| 0.85 | 255.0 |
| 0.90 | 255.0 |
| 0.95 | 255.0 |
| 1.00 | 255.0 |

Using the reference lighting curve shown in Table 5 and the specific lighting curve shown in Table 6, the transformation function T was determined. Table 7 illustrates one exemplary embodiment of the resulting transformation function T, which was saved in tabular form in a file.

TABLE 7

| Transformation function T | |
|---|---|
| Input Light Setting | Calibrated Light Setting |
| 0.00 | 0.00 |
| 0.05 | 0.05 |

TABLE 7-continued

| Transformation function T | |
|---|---|
| Input Light Setting | Calibrated Light Setting |
| 0.10 | 0.10 |
| 0.15 | 0.14 |
| 0.20 | 0.18 |
| 0.25 | 0.21 |
| 0.30 | 0.24 |
| 0.35 | 0.29 |
| 0.40 | 0.32 |
| 0.45 | 0.35 |
| 0.50 | 0.38 |
| 0.55 | 0.41 |
| 0.60 | 0.44 |
| 0.65 | 0.48 |
| 0.70 | 0.52 |
| 0.75 | 0.55 |
| 0.80 | 0.58 |
| 0.85 | 0.61 |
| 0.90 | 0.64 |
| 0.95 | 0.67 |
| 1.00 | 0.70 |

Each light source will use a different transformation function look-up table. Therefore, there are as many transformation function look-up tables as there are light sources for a given vision system. Each transformation function look-up table will be saved in a different file.

In various other exemplary embodiments, the reference lighting curve can be generated based on statistical analysis of a number of vision systems, or on sufficient design knowledge of the vision system and optical simulations. Thus, it should be appreciated that any known or later developed method for generating the reference lighting curve can be used, so long as the reference lighting curve remains representative of a light intensity sensed by a light intensity sensing device of a reference vision system and an light intensity value used to drive a light source of the reference vision system.

Conventional vision systems and methods were modified to read a look-up table for each light source when various exemplary embodiments of the systems and methods according to this invention were experimentally tested. Various exemplary embodiments of the systems and methods according to this invention use these look-up tables to convert the input light settings to calibrated light settings before sending these values to the lighting control system. For example, using the look-up table of the Table 7, when the user set the input light setting to 0.80, various exemplary embodiments of the systems and methods according to this invention will convert this value to 0.58 before sending this value to the lighting control system. If an input light intensity command value, for example an input light intensity command value of 0.12, is not in the look-up table, various exemplary embodiments of the systems and methods according to this invention use linear interpolation to calculate the calibrated value.

The results of the systems and methods according to this invention to calibrate the vision system show that it is possible to have a calibrated lighting system. That is, calibrated vision systems will produce images with similar brightness under similar input light intensity command values for the identically equipped vision systems. The calibration is performed by using a pre-defined lighting behavior, called reference lighting curve. Calibrated vision systems will modify their specific lighting behavior to emulate this reference lighting curve.

In various exemplary embodiments, a different reference lighting curve is provided for every light source of every class of vision system. However, the calibration systems and methods of this invention are flexible and allow other configurations, such as having the same reference lighting curve for different classes of vision systems. This configuration may be useful for a customer having two different classes of vision systems who wants to run part programs indistinctly on both classes of visions systems. It is important to note that the reference lighting curve will be determined with the class of vision system having the weakest lighting system. Therefore, having a single reference lighting curve for different classes of vision systems will undermine the lighting power of the classes of vision systems with the stronger lighting system.

It should also be appreciated that the reference lighting curve can be generated from a specific vision system. In this case, the reference lighting curve is not used to force the specific vision system to follow the input light intensity command values of an external reference visions system. Rather, the reference lighting curve in this case represents the lighting behavior of the specific vision system at a particular point in time.

One particularly useful time to generate such a reference lighting curve for a specific vision system is before a part program that will be used on that specific vision system will be created. By calibrating, and, more importantly, re-calibrating the specific vision system over time to the reference lighting curve generated for that specific vision system, the lighting behavior of that specific vision system is prevented from drifting away from the reference lighting behavior. Thus, any part programs created for that specific vision system will remain operable by that specific vision system, even as the lighting system of that specific vision system ages and otherwise drifts away from the reference lighting behavior.

Another particularly useful time to generate such a reference lighting curve for a specific vision system is before a part program that will be run on other vision systems will be created. The subsequently created part program should then run on these other vision systems, provided that these vision systems are calibrated using this reference lighting curve.

The calibration systems and methods according to this invention allow the same part program to be run on different vision systems with identical equipment, i.e. vision systems having different light output intensity values for the same input light intensity command value.

The calibration systems and methods according to this invention also allow a part program to run consistently on the same vision system, even when the lighting conditions change, for example, due to increased ambient lighting, lamp aging, replacing an old lamp with a new lamp, or the like.

The calibration systems and methods according to this invention also allow bad lighting conditions, for example an old lamp, to be detected.

The calibration systems and methods according to this invention also allow misalignment of the optical system, for example misalignment of the programmable ring light after part collision, to be detected.

The calibration systems and methods according to this invention also allow machine vision systems to reliably detect differences of color on the workpieces measured, even if a black and white camera is used because the illumination is calibrated more reliably and therefore variations in intensity sensed by the camera may be reliably attributed to the workpiece. Assuming the reflectance of the work pieces remains similar, variations in intensity may be attributed to color changes in certain situations.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A method for calibrating a lighting system of a specific vision system, based on a defined reference relationship that is representative of light intensities sensed by a light intensity sensing device of a reference vision system and corresponding light intensity values used to drive a light source of the reference vision system, comprising:

determining a specific relationship between the light intensities sensed by a light intensity sensing device of the specific vision system and corresponding light intensity values used to drive a light source of the specific vision system; and determining, based on the reference relationship and the specific relationship, a transformation that transforms an input light intensity value to be used to drive the light source of the specific vision system to a transformed light intensity value, such that, if the transformed light intensity value is used to drive the light source of the specific vision system and if the light source of the reference vision system were driven at the input light intensity value, the light intensity sensed by the light intensity sensing device of the specific vision system corresponds to the light intensity that would be sensed by the light intensity sensing device of the reference vision system.

2. The method of claim 1, wherein the reference vision system and the specific vision system are one of the same physical vision system and different visions systems of a same type of vision system.

3. The method of claim 1, wherein the light intensity sensing device is a camera.

4. The method of claim 1, further comprising:

determining whether the transformation needs to be updated; and if the transformation needs to be updated, repeating the specific relationship determining and transformation determining steps.

5. The method of claim 4, wherein determining whether the transformation needs to be updated comprises determining whether a length of time, since the transformation was determined, is greater than a threshold length of time.

6. The method of claim 4, wherein determining whether the transformation needs to be updated comprises:

measuring the light intensity sensed by the light intensity sensing device of the specific vision system for at least one light intensity value used to drive the light source of the specific vision system;

determining, for each at least one light intensity value, a difference between the measured light intensity sensed for that light intensity value and the corresponding light intensity that would be sensed by the light intensity sensing device of the reference vision system if the light source of the reference vision system were driven at that input light intensity value; and determining if, for at least one light intensity value, the difference for that light intensity value is greater than a threshold difference.

7. The method of claim 1, wherein, when the lighting systems of each of the specific and reference visions systems each contain a plurality of light sources, the reference relationship comprises one reference relationship for each light source, the method further comprising determining, for each light source of the specific vision system, a specific relationship between the light intensity sensed by the light intensity sensing device of the specific vision system and a light intensity value used to drive that light source of the specific vision system; and determining, for each light source, based on the reference relationship and the specific relationship, a transformation that transforms an input light intensity value to be used to drive that light source of the specific vision system to a transformed light intensity value, such that, when the transformed light intensity value is used to drive that light source of the specific vision system, the light intensity sensed by the light intensity sensing device of the specific vision system corresponds to the light intensity that would be sensed by the light intensity sensing device of the reference vision system if the corresponding light source of the reference vision system were driven at the input light intensity value.

8. The method of claim 7, wherein the plurality of light sources comprises at least two of a stage light, a coaxial light, a ring light and a programmable ring light.

9. The method of claim 7, wherein the plurality of light sources comprises a plurality of differently colored light emitting elements of a single light device.

10. The method of claim 1, wherein determining the specific relationship between the light intensity sensed by the light intensity sensing device of the specific vision system and the light intensity value used to drive the light source of the specific vision system comprises:

selecting a region of a field of view of the light intensity sensing device; and determining the light intensity sensed by the light intensity sensing device in the selected region.

11. The method of claim 10, wherein selecting the region of the field of view of the light intensity sensing device comprises selecting at least one portion of the field of view as the region, each portion having a selected dimension.

12. The method of claim 10, wherein selecting the region of the field of view of the light intensity sensing device comprises selecting a portion of the field of view that includes a brightest light intensity as the region.

13. The method of claim 1, wherein determining the specific relationship between the light intensity sensed by the light intensity sensing device of the specific vision system and the light intensity value used to drive the light source of the specific vision system comprises determining at least one statistical value based on input images values of an image captured by the light intensity sensing device within at least a portion of a field of view of the light intensity sensing device as the specific relationship.

14. The method of claim 1, wherein determining the specific relationship between the light intensity sensed by the light intensity sensing device of the specific vision system and the light intensity value used to drive the light source of the specific vision system comprises placing, for at least one light intensity value of a range of light intensity values over which the specific relationship is determined, a target on a stage of the vision system.

15. The method of claim 14, wherein the target is at least one of an empty stage, an attenuator, reflective, transmissive.

16. The method of claim 14, wherein placing, for at least one light intensity value of the range of light intensity values over which the specific relationship is determined, a target on the stage of the vision system comprises:

placing, if the light intensity sensed by the light intensity sensing device is not within a predetermined range of values, a different target on the stage of the vision system.

17. The method of claim 1, wherein determining the specific relationship between the light intensity sensed by the light intensity sensing device of the specific vision system and the light intensity value used to drive the light source of the specific vision system comprises determining the specific relationship over a range of light intensity values.

18. The method of claim 1, further comprising:

inputting an input light intensity command value usable to drive the light source of the specific vision system;

transforming the input light intensity command value to a transformed input light intensity command value based on the transformation; and driving the light source using the transformed input light intensity command value.

19. A method for generating illumination for an object to be imaged by a vision system comprising a light source and a light intensity sensing device, comprising:

inputting an input light intensity value usable to drive the light source of the vision system;

transforming the input light intensity value to a transformed input light intensity value based on a transformation; and driving the light source using the transformed input light intensity value;

wherein the transformation transforms the input light intensity value to be used to drive the light source of the vision system to the transformed input light intensity value, such that, if the transformed input light intensity value is used to drive the light source of the vision system and if the light source of the reference vision system were driven at the input light intensity value, the light intensity sensed by the light intensity sensing device of the vision system corresponds to a light intensity that would be sensed by a light intensity sensing device of a reference vision system.

20. A method for generating illumination for an object to be imaged by a specific vision system comprising a light source and a light intensity sensing device, comprising:

inputting an input light intensity value usable to drive the light source of the vision system;

transforming the input light intensity value to a transformed input light intensity value based on a transformation; and driving the light source using the transformed input light intensity value;

wherein the transformation is based on a defined reference relationship representative of light intensity values useable to drive a light source of the reference vision system and corresponding light intensities sensed by a light intensity sensing device obtained when the light source of the reference vision system is driven at the light intensity values, and light intensity values useable to drive a light source of the specific vision system and corresponding light intensities sensed by a light intensity sensing device obtained when the light source of the specific vision system is driven at the light intensity values.

* * * * *